US011440334B2

(12) United States Patent
Tokuda

(10) Patent No.: US 11,440,334 B2
(45) Date of Patent: Sep. 13, 2022

(54) CUTTER APPARATUS AND PRINTING APPARATUS

(71) Applicant: SEIKO EPSON CORPORATION, Tokyo (JP)

(72) Inventor: Takeshi Tokuda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 232 days.

(21) Appl. No.: 16/795,348

(22) Filed: Feb. 19, 2020

(65) Prior Publication Data

US 2020/0269612 A1 Aug. 27, 2020

(30) Foreign Application Priority Data

Feb. 21, 2019 (JP) ..... JP2019-029700

(51) Int. Cl.
*B41J 11/70* (2006.01)
*B26D 7/00* (2006.01)
*B26D 1/08* (2006.01)

(52) U.S. Cl.
CPC ..... *B41J 11/70* (2013.01); *B26D 1/085* (2013.01); *B26D 7/00* (2013.01); *B26D 2007/005* (2013.01)

(58) Field of Classification Search
CPC ..... B41J 11/70
USPC ..... 400/621
See application file for complete search history.

(56) References Cited

U.S. PATENT DOCUMENTS 6,164,854 A * 12/2000 Otsuki ..... B26D 1/305 400/621
6,361,231 B1 * 3/2002 Sato ..... B41J 11/703 400/621
7,392,731 B2 * 7/2008 Nonaka ..... B26D 1/0006 101/227
7,819,599 B2 * 10/2010 Kobayashi ..... B41J 11/003 400/621
2011/0158731 A1 6/2011 Suzuki et al.
2014/0125000 A1 5/2014 Suzuki et al.

FOREIGN PATENT DOCUMENTS

JP 2011-136472 7/2011
JP 2011-143601 7/2011
JP 2013-176813 9/2013
WO WO-2016117154 A1 * 7/2016 ..... B26D 1/08

* cited by examiner

*Primary Examiner* — Matthew G Marini
(74) *Attorney, Agent, or Firm* — Workman Nydegger

(57) ABSTRACT

A cutter apparatus is provided that includes a fixed blade and a movable blade positioned facing the fixed blade, and that is configured to cut a medium transported between the fixed blade and the movable blade. The movable blade includes: a guide portion that is driven to reciprocate between a standby position at a distance from the medium and a cutting position, where the movable blade intermeshes with the fixed blade, protrudes further toward the movable blade than a cutting edge of the fixed blade when the movable blade is in the standby position, and is pressed by the movable blade to move in a state of being contact with the fixed blade when the movable blade is in the cutting position; and a biasing member configured to bias the guide portion toward the fixed blade.

7 Claims, 8 Drawing Sheets

CUTTER APPARATUS AND PRINTING APPARATUS

The present application is based on, and claims priority from JP Application Serial Number 2019-029700, filed Feb. 21, 2019, the disclosure of which is hereby incorporated by reference herein in its entirety.

BACKGROUND

1. Technical Field

The present disclosure relates to a cutter apparatus and a printing apparatus.

2. Related Art

In the related art, there are known printers that include a cutter configured to cut a recording paper after printing, and perform a partial cut in which a portion of the recording paper remains uncut to prevent the cut recording paper from being scattered by blowing air from an air conditioner or the like (refer to JP-A-2011-143601, for example).

When a partial cut is performed, one end portion and a portion of a center portion in a width direction of the recording paper are left uncut, making it is possible to prevent the cut recording paper from scattering. Further, the partially cut recording paper, while held in the printer by the uncut portion, can be easily torn as necessary.

When a partial cut is performed on the recording paper, the cut recording paper may warp. When this recording paper is backfed, the warped recording paper can get caught in a blade of a cutter.

SUMMARY

According to an aspect for solving the above-described problems, a cutter apparatus for cutting a medium by a first blade and a second blade, the first blade moving between a standby position and a cutting position, the cutter apparatus comprising a guide portion configured to protrude further toward the first blade than a cutting edge of the second blade when the first blade is in the standby position, a first urging member configured to urge the guide portion toward the second blade, and when the first blade moves from the standby position to the cutting position, the guide portion is pressed by the first blade to move in a state of contacting with the second blade.

In the cutter apparatus described above, the second blade may includes a curvature in a thickness direction and, when the first blade moves to the cutting position and intersects with the second blade, the second blade may flex, thereby causing the curvature of the second blade to change conorming to the first blade.

In the cutter apparatus described above, the first blade may includes a cutting edge having a V-shape extending in two directions toward the second blade, a pair of the guide portions are provided to the cutting edge of the first blade, and the pair of the guide portions is configured to move in accordance with a movement of the first blade.

In the cutter apparatus described above, the cutter apparatus may be of a scissors type having the first blade and the second blade that form a medium cutting point, and cuts the medium as the medium cutting point moves while the first blade is moving from the standby position to the cutting position.

In the cutter apparatus described above, the first urging member may be a leaf spring.

In the cutter apparatus described above, the first blade may be provided to a first structure, the second blade may be provided to a second structure separate from the first structure, and the second structure may be configured to change in posture relative to the first structure.

In the cutter apparatus described above, a portion other than a cutting edge of the first blade may abut against the guide portion while the first blade moves from the standby position to the cutting position.

Further, according to another aspect for achieving the above-described object, a printing apparatus includes a transport unit configured to transport a medium, a printing unit configured to perform printing on the medium, and the cutter apparatus provided downstream of the printing unit in a transport direction of the medium and configured to cut the medium.

DESCRIPTION OF EXEMPLARY EMBODIMENTS

1. First Exemplary Embodiment

1-1. Configuration of Printing Apparatus

Figure 1:
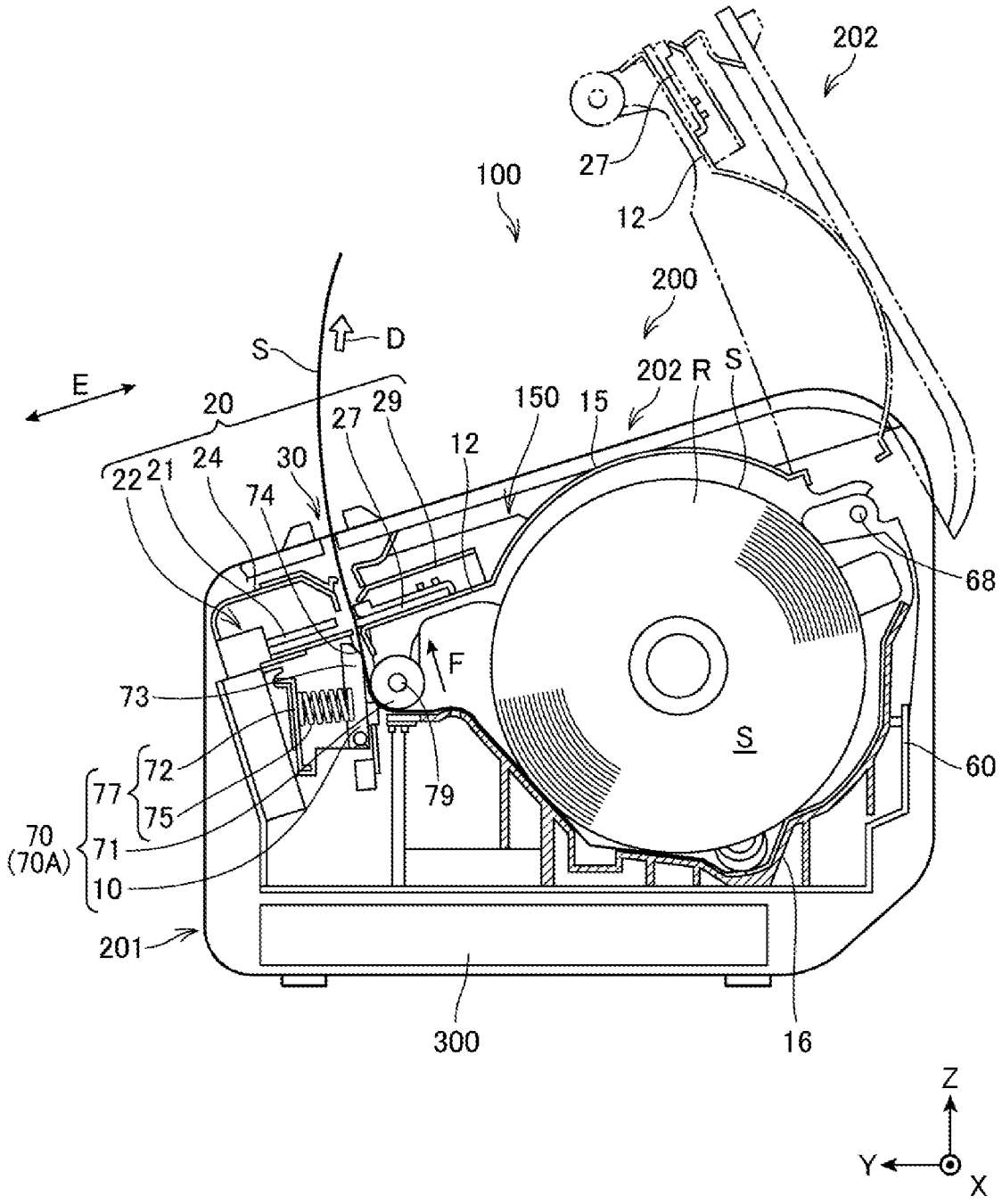
FIG. 1 is side sectional view of an overall structure of a printing apparatus.

FIG. 1 is side sectional view illustrating an overall structure of a printing apparatus 100.

The printing apparatus 100 is, for example, applied to a point-of-sale (POS) system, and prints and issues strip-shaped slips, receipts, coupons, tickets, and the like as individual sheets. The printing apparatus 100 is capable of using an elongated paper or sheet as a medium for printing, and the present exemplary embodiment describes an example in which the printing apparatus 100 is a thermal printer that prints on thermal paper S having a roll shape as the medium. Note that the printing apparatus 100 is not limited to a thermal printer, and may be a printing apparatus with a different printing system such as an inkjet printer.

The printing apparatus 100 houses the thermal paper S wound in a roll shape, draws out and transports the thermal paper S from a roll, prints predetermined information on the thermal paper S, and cuts the thermal paper S to a predetermined length. The thermal paper S wound in a roll shape is referred to as roll paper R.

In FIG. 1, a paper width direction of the thermal paper S is denoted by reference sign X, a direction orthogonal to the X direction is denoted by reference sign Y, and a direction orthogonal to the X direction and the Y direction is denoted by reference sign Z. Further, a transport direction of the thermal paper S is denoted by reference sign F.

As illustrated in FIG. 1, the printing apparatus 100 includes a printer mechanism 150, an outer case 200, and a control unit 300. Note that the control unit 300 may be described as a processor.

The outer case 200 includes a main body casing 201 that covers a main body frame 60 and a cover casing 202 that covers a cover frame 12.

The printer mechanism 150 includes the main body frame 60, the cover frame 12, a roll paper holder 16, a cutter apparatus 20, and a printing unit 70. The printing unit 70 also functions as a transport unit 70*a* for transporting the thermal paper S.

The main body frame 60 is formed in a substantially box shape including an opening upward in the Z direction and frontward in the Y direction. The cover frame 12 is attached to an upper portion of the main body frame 60 so as to be freely opened and closed about a support shaft 68. The cover frame 12 is provided with a recessed portion 15 for avoiding contact with the roll paper R when the cover frame 12 is closed.

The roll paper holder 16 is a space formed in a rear portion of the main body frame 60 and is covered by the cover frame 12.

The printing unit 70 is provided on a transport path D of the thermal paper S that extends from the roll paper holder 16 to a paper discharge port 30 of the cutter apparatus 20. The printing unit 70 includes a thermal head 10, a head retaining mechanism 77, and a platen 71. When the cover frame 12 is opened, the thermal head 10 and the head retaining mechanism 77 separate to the main body frame 60 side, and the platen 71 separates to the cover frame 12 side.

The thermal head 10 includes a plurality of heating elements (not illustrated) disposed in a paper width direction indicated by the reference sign X, and a heat sink 73. A slanting guide portion 74 is formed across a longitudinal direction of the heat sink 73, upward in the Z direction of the heat sink 73. When the cover frame 12 is closed, the slanting guide portion 74 slides the platen 71, described later, and guides the platen 71 to a predetermined position.

The head retaining mechanism 77 includes a head pressing plate 72 and a spring 75 attached to the head pressing plate 72, and is attached to the main body frame 60. The spring 75, which is a compression coil spring, abuts the head pressing plate 72 and the heat sink 73 of the thermal head 10, and biases the thermal head 10 toward the platen 71.

The platen 71 is a roller formed from an elastic member such as rubber, and is rotatably supported on the cover frame 12 via a platen bearing 79. When the cover frame 12 is closed, the platen 71, after being guided to the slanting guide portion 74 of the thermal head 10, is pressed against the heating elements of the thermal head 10.

The thermal head 10 and the platen 71 are pressed against the thermal paper S, sandwiching the thermal paper S. The platen 71 is rotated by the power of a paper feed motor (not illustrated), thereby transporting the thermal paper S toward the paper discharge port 30. The printing apparatus 100 selectively energizes the heating elements of the thermal head 10 while transporting the thermal paper S, thereby printing predetermined information on the thermal paper S.

The thermal paper S on which printing was performed by the printing unit 70 is cut to a predetermined length by the cutter apparatus 20 and issued as an individual sheet such as a receipt.

Figure 6:
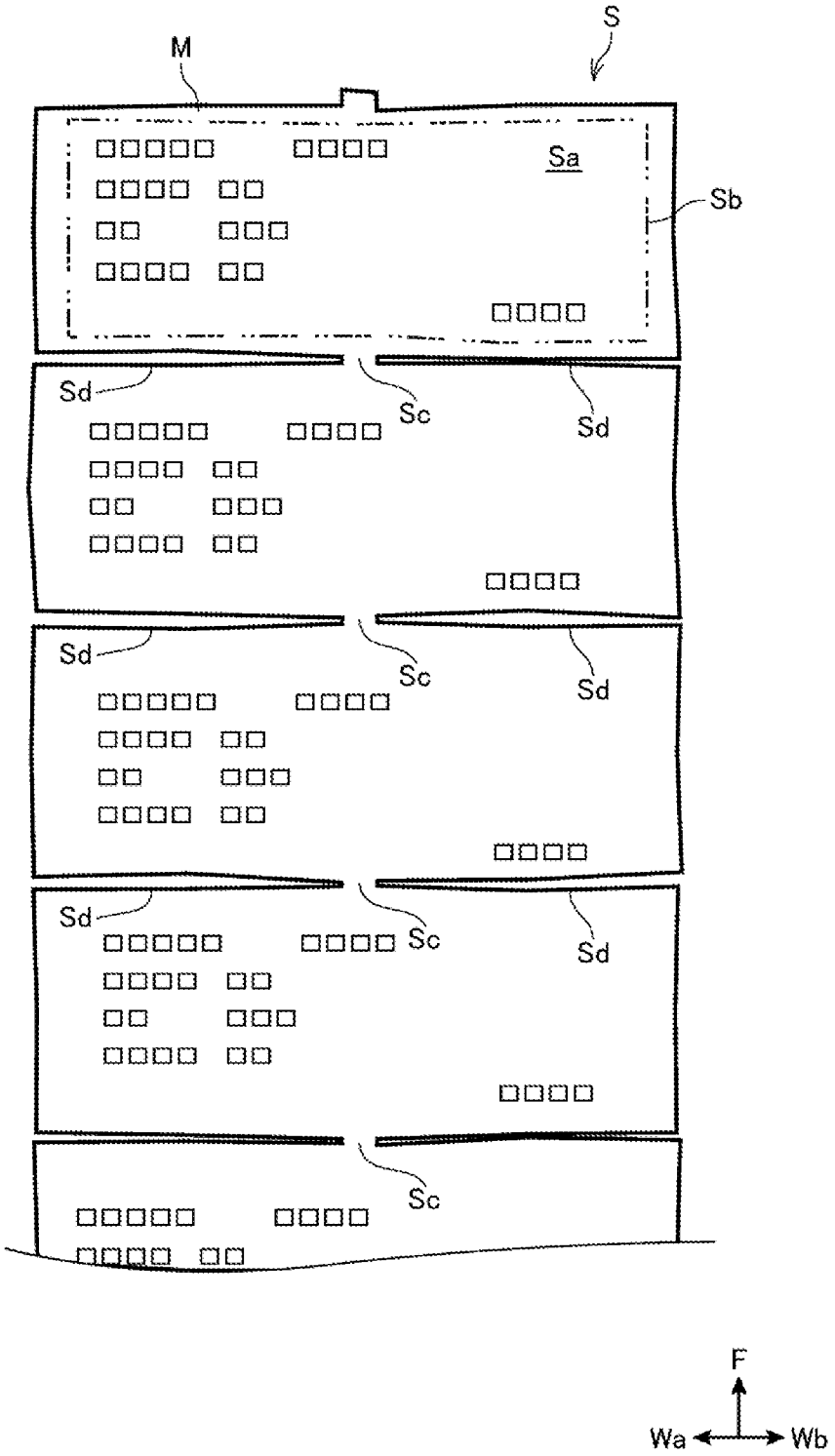
FIG. 6 is an explanatory view illustrating an example of thermal paper on which printing was performed.

FIG. 6 is an explanatory view illustrating an example of the thermal paper S on which printing was performed. Reference sign Wa and reference sign Wb denote width directions of the thermal paper S and, in the example of FIG. 6, are orthogonal to the transport direction F.

In the thermal paper S, for each individual slip Sa, a cut Sd is made from both ends in the width direction toward a center, and an uncut portion Sc is formed in the center. In this way, because the uncut portion Sc is formed, the thermal paper S after cutting is in a connected state, and does not scatter outside the paper discharge port 30. This cutting method is referred to as a partial cut, and the thermal paper S can be easily torn off as needed.

The control unit 300 is disposed in a lower portion of the printer mechanism 150. The control unit 300 is housed in the outer case 200 along with the printer mechanism 150 described above. The control unit 300 comprehensively controls the operation of the printing apparatus 100.

The control unit 300 controls each unit of the printing apparatus 100 in accordance with commands input from a host computer (not illustrated) coupled to the printing apparatus 100. For example, when a print command providing printing instructions and data of characters and images to be printed are input from the host computer, the control unit 300 operates the printing unit 70, causing the printing unit 70 to transport and perform printing on the thermal paper S, and subsequently cuts the thermal paper S by the cutter apparatus 20.

1-2. Configuration of Cutter Apparatus

The cutter apparatus 20 is disposed in a vicinity of the paper discharge port 30, and partially cuts, by a movable blade 21 and a fixed blade 27, the thermal paper S after printing by the thermal head 10. The movable blade 21 is attached to the main body frame 60 and the fixed blade 27 is attached to the cover frame 12. Note that the movable blade and the fixed blade may be referred to as a first blade and a second blade.

The movable blade 21 and a blade driving portion 22 that drives the movable blade 21 are housed in a first cutter cover 24 provided to the main body frame 60. On the other hand, the fixed blade 27 is housed in a second cutter cover 29 provided to the cover frame 12, and is disposed in a position facing the movable blade 21 with the transfer path D interposed therebetween.

When the roll paper R is set in the roll paper holder 16 and the cover frame 12 is opened, the fixed blade 27 moves with the cover frame 12, separating the fixed blade 27 from the movable blade 21. Then, the roll paper R is fed into the roll paper holder 16, and the thermal paper S drawn from the roll paper R is passed between the movable blade 21 and the fixed blade 27. When the cover frame 12 is closed, the thermal paper S is disposed between the movable blade 21 and the fixed blade 27.

The movable blade 21 is driven by the blade driving portion 22 and reciprocates between a standby position and a cutting position. In the description of the present exemplary embodiment and in FIG. 2 to FIG. 5, the standby position and the cutting position of the movable blade 21 are denoted by reference signs UP and CP, respectively.

Figure 2:
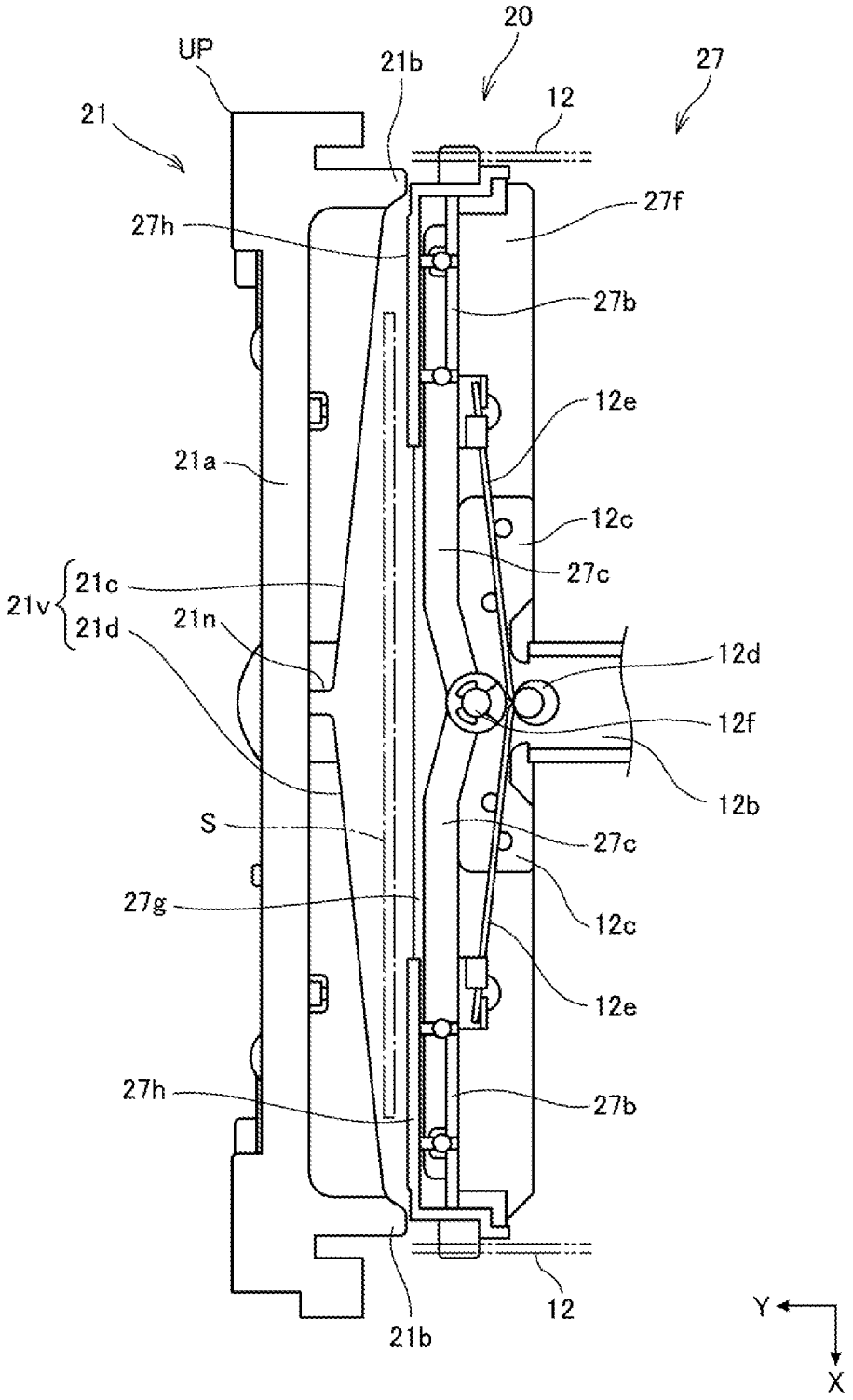
FIG. 2 is a plan view of main parts of a cutter apparatus.
Figure 3:
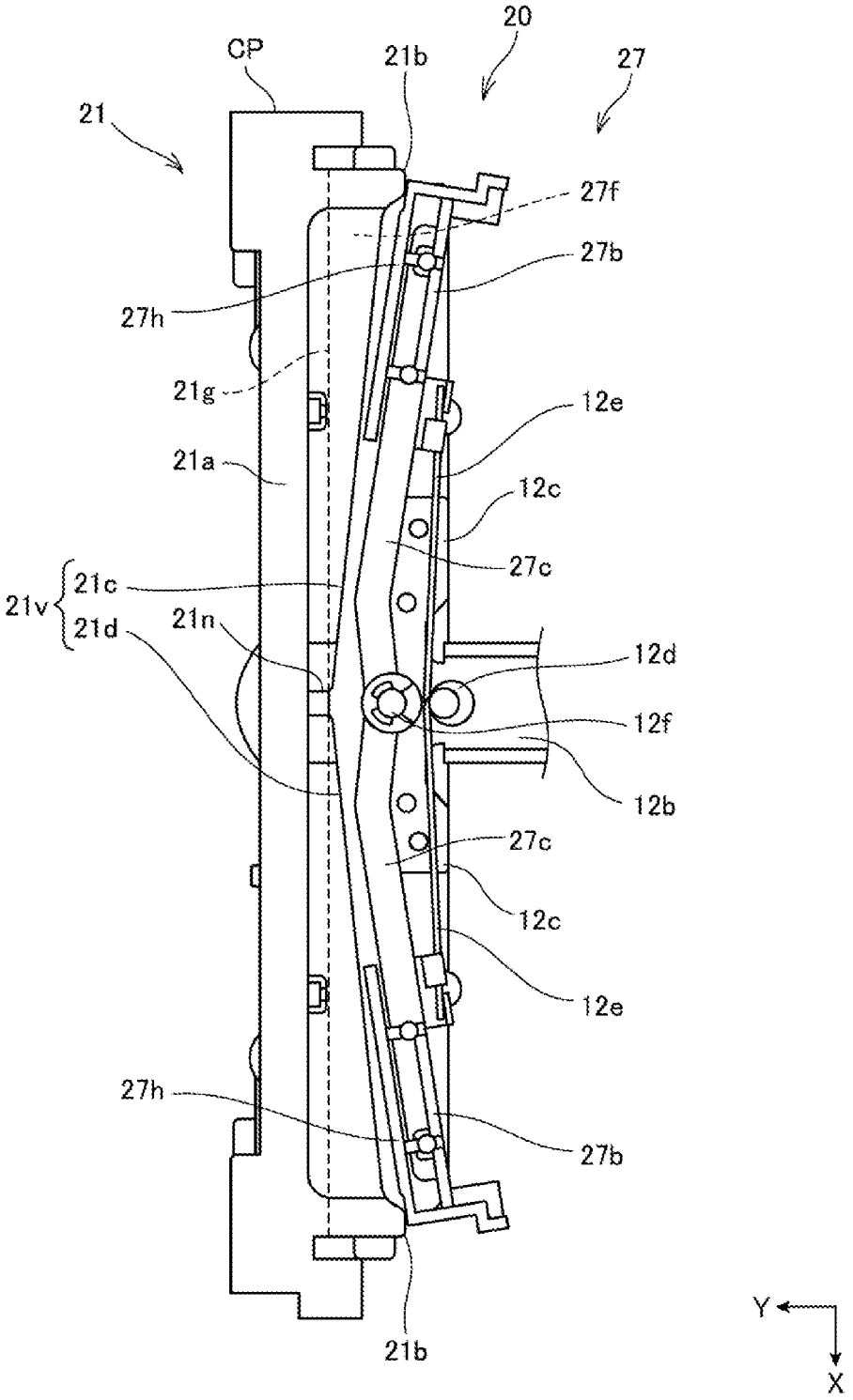
FIG. 3 is a plan view of the main parts of the cutter apparatus.

FIG. 2 and FIG. 3 are plan views of main parts of the cutter apparatus 20. FIG. 2 illustrates a state in which the movable blade 21 is positioned in the standby position UP. FIG. 3 illustrates a state in which the movable blade 21 is positioned in the cutting position CP.

Figure 4:
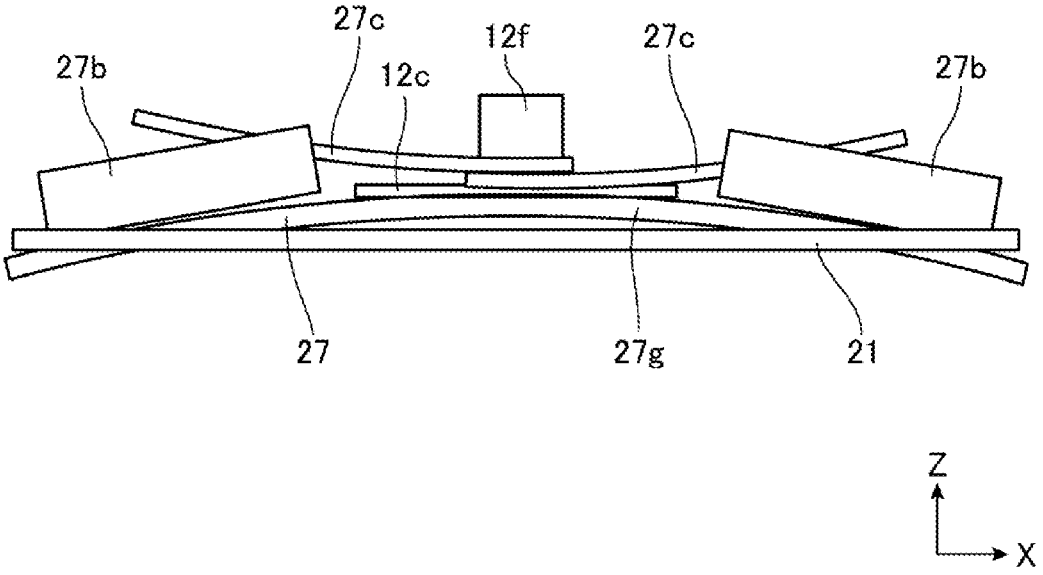
FIG. 4 is a front view of the main parts of the cutter apparatus.
Figure 5:
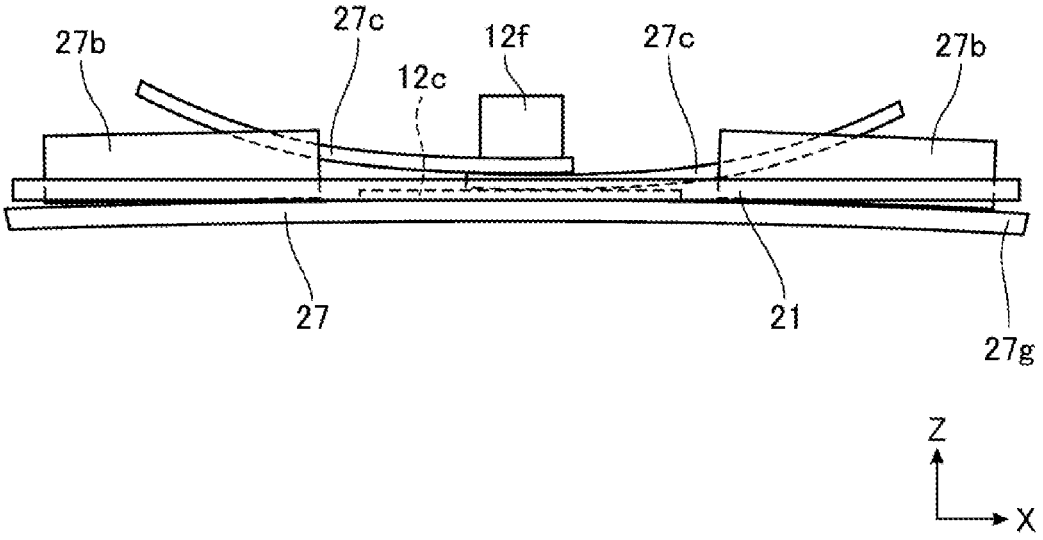
FIG. 5 is a front view of the main parts of the cutter apparatus.

FIG. 4 and FIG. 5 are front views of the main parts of the cutter apparatus 20. FIG. 4 illustrates a state in which the movable blade 21 is in the standby position UP, and FIG. 5 illustrates a state in which the movable blade 21 is in the cutting position CP.

The reference sign Y in FIG. 2 and FIG. 3 denotes frontward, and the reference sign X denotes rightward. The reference sign Z in FIG. 4 and FIG. 5 denotes upward, and the reference sign X denotes rightward. The left-right direction in these FIGS. 2 to 5 coincide with a width direction of the printing apparatus 100, the movable blade 21, and the fixed blade 27.

As illustrated in FIG. 2, the movable blade 21 is, for example, formed from a long plate-like member made of a metal, and a V-shaped cutting edge 21*v* is formed on a side facing the fixed blade 27. The V-shaped cutting edge 21*v* is an end of the movable blade 21 on a rear portion side of the printing apparatus 100. The V-shaped cutting edge 21*v* is a blade having a V shape obtained by combining a left cutting edge 21*c* and a right cutting edge 21*d*, with both end portions in the width direction of the movable blade 21 closest to the fixed blade 27 and the center in the width direction furthest away from the fixed blade 27. The cutting edge 21*c* and the cutting edge 21*d* are disposed to form a gap in the center of the movable blade 21 in the width direction. This gap is referred to as notch portion 21*n*. Note that the V-shaped cutting edge 21*v* need not be an edge having a V shape in a strict sense, and may have a configuration in which one cutting edge and another cutting edge are connected at a predetermined angle. Further, the notch portion 21*n* is not limited to the center of the movable blade 21 in the width direction, and may be provided in a position shifted from the center. Then, the left cutting edge 21*c* and the right cutting edge 21*d* are not limited to being linear in shape, and may partially have a curved shape or the like. The V-shaped cutting edge 21*v* corresponds to an example of a first cutting edge.

A holder 21*a* that holds a front portion and left and right end portions of the movable blade 21 is attached to the movable blade 21. The movable blade 21 is connected to the blade driving portion 22 via the holder 21*a*. When the blade driving portion 22 operates, the blade driving portion 22 moves the movable blade 21 along with the holder 21*a* in parallel from the standby position UP toward the cutting position CP. The movement is from the standby position UP toward fixed blade 27. Further, the blade driving portion 22 moves the movable blade 21 in parallel from the cutting position CP toward the standby position UP. In this way, the movable blade 21 moves with the holder 21*a* from the cutting position CP and returns to the standby position UP.

The holder 21*a* includes a pair of protruding portions 21*b*. The protruding portions 21*b* protrude further toward positions close to the fixed blade 27 than an end portion of the V-shaped cutting edge 21*v* closest to the fixed blade 27. In the process in which the movable blade 21 moves from the standby position UP to the cutting position CP, the protruding portions 21*b* serve as heads and come into contact with the fixed blade 27 before the V-shaped cutting edge 21*v*. The protruding portions 21*b* come into contact with guide portions 27*b* provided to the fixed blade 27, and press and move the guide portions 27*b* by the power of the blade driving portion 22.

The fixed blade 27 is, for example, formed from a long plate-like plate member made of a metal, and a cutting edge 27*g* is formed on an end facing the movable blade 21. The cutting edge 27*g* is substantially linear in shape, and the cutting edge 27*g* and the V-shaped cutting edge 21*v* sandwich the thermal paper S, thereby cutting the thermal paper S. Here, because there is no V-shaped cutting edge 21*v* in the notch 21*n*, the thermal paper S is not cut, and the uncut portion Sc is formed. Note that the fixed blade 27 is not limited to being linear in shape, and may partially have a curved shape or the like. Further, the cutting edge 27*g* corresponds to an example of a second cutting edge.

A stay 12*b* extending toward the movable blade 21 is fixed to the cover frame 12. A plate 12*c* extending along the width of the fixed blade 27 is integrally provided to a tip end portion of the stay 12*b*, and the fixed blade 27 is fixed to a lower surface of the plate 12*c*.

As illustrated in FIG. 4, the fixed blade 27 is provided with a curvature in a direction in which both ends are lowered relative to a center in the width direction, that is, so as be upwardly convex. The direction of the curvature can also be referred to as the thickness direction of the fixed blade 27. Due to this curvature, an upper surface 27*f* of the fixed blade 27 is a curved surface that is upwardly convex.

The two guide portions 27*b* are disposed on the upper surface 27*f* of the fixed blade 27. The pair of guide portions 27*b* are separately disposed at both end portions of the fixed blade 27 in the width direction, and are each capable of sliding over the upper surface 27*f*.

The two guide portions 27*b* are each supported by an arm 27*c*. The arm 27*c* is a rod-like member rotatably attached to a support shaft 12*f* vertically provided on the stay 12*b*. The support shaft 12*f* is a shaft protruding upward from the upper surface 27*f*, and the two arms 27*c* corresponding to each of the two guide portions 27*b* are attached to the support shaft 12*f*. The other end of the arm 27*c* is fixed to the guide portion 27*b*, and the arm 27*c* and the guide portion 27*b* rotate integrally about the support shaft 12*f*. The arm 27*c* corresponds to an example of a first biasing member (a first urging member).

The arm 27*c* is a leaf spring that flexes in the up-down direction of the printing apparatus 100, that is, in the thickness direction of the fixed blade 27. The arm 27*c* is attached to the support shaft 12*f* in a flexed state as illustrated in FIG. 4 and biases (urges) the guide portion 27*b* in a direction that presses against the upper surface 27*f* of the fixed blade 27 by an elastic force thereof. This biasing force also acts when the guide portion 27*b* rotates with the arm 27*c*, and thus the guide portion 27*b* remains in a state of contact with the upper surface 27*f* of the fixed blade 27 by the elasticity of the arm 27*c*.

The arm 27*c* is not limited to a leaf spring as long as the arm 27*c* has an elastic force that biases the guide portion 27*b* to the fixed blade 27. For example, a plurality of members including a compression coil spring and an elastic member such as rubber may be disposed in place of the arm 27*c*.

The guide portion 27*b* is movable in a front-back direction by rotating the arm 27*c* about the support shaft 12*f*. The cutter apparatus 20 includes a spring 12*e* that biases the guide portion 27*b* toward the movable blade 21.

The spring 12*e* is supported by a protruding portion 12*d* vertically provided on the stay 12*b*. The protruding portion 12*d* is provided in the center of the fixed blade 27 in the width direction, is a shaft protruding upward, and supports a center portion of the spring 12*e*. The spring 12*e* is constituted by a torsion coil spring, for example, and biases (urges) each of the two guide portions 27*b* against the protruding portions 12*d* toward the movable blade 21. The spring 12*e* corresponds to an example of a second biasing member (a second urging member).

In this manner, the guide portion 27*b* is biased toward the fixed blade 27 by the arm 27*c* in the up-down direction of the printing apparatus 100, and is biased toward the movable blade 21 by the spring 12*e* in the front-back direction. The guide portion 27*b* is movable rearward against the biasing force of the spring 12*e*. With the fixed blade 27 having a curvature, the guide portion 27*b* moves along the upper surface 27*f*, which is a curved surface, when moving rearward. In this process, the biasing force of the arm 27*c* allows the guide portion 27*b* to move without rising from the upper surface 27*f*.

In the cutter apparatus 20, when the movable blade 21 moves from the standby position UP toward the cutting position CP, the protruding portions 21*b* of the movable blade 21 come into contact with the guide portions 27*b*. When the movable blade 21 moves further, the protruding portions 21*b* press the guide portions 27*b* against the elastic force of the springs 12*e* and the guide portions 27*b* moves rearward. Accordingly, the guide portions 27*b* do not interfere with an operation in which the movable blade 21 is moved to cut the thermal paper S.

Further, when the movable blade 21 moves from the cutting position CP to the standby position UP, the guide portions 27*b* move frontward following the movable blade 21 by the elastic force of the springs 12*e*. When the movable blade 21 moves further, the contact between the guide portions 27*b* and the protruding portions 21*b* is released, and the guide portions 27*b* return to predetermined positions. The return positions of the guide portions 27*b*, that is, the positions in a state of non-contact with the movable blade 21, are positions protruding further toward the movable blade 21 than toward the cutting edge 27*g* of the fixed blade 27. These return positions are positioned by the abutment of the guide portions 27*b* and the fixed blade 27 or by the abutment of the guide portions 27*b* and the cover frame 12. Both end portions in the left-right direction of the fixed blade 27 are held by the cover frame 12.

A smooth guide surface 27*h* is formed at a front end of each of the guide portions 27*b*. The guide surface 27*h* is positioned frontward from the fixed blade 27 in the return position of the guide portion 27*b*. That is, the guide surface 27*h*, with the movable blade 21 in the standby position UP, protrudes to the transport path D. As a result, when the thermal paper S on which printing was performed by the printing unit 70 passes between the fixed blade 27 and the movable blade 21, the thermal paper S comes into contact with the guide surfaces 27*h* and moves along the guide surfaces 27*h*. Thus, the thermal paper S is less likely to come into contact with the cutting edge 27*g* of the fixed blade 27, and the thermal paper S is smoothly transported without getting caught on the cutting edge 27*g*.

As described above, the guide portion 27*b* is biased to the upper surface 27*f* of the fixed blade 27 by the arm 27*c*, and thus a state in which the guide portion 27*b* and the upper surface 27*f* come into contact with each other substantially without any gap is maintained. This makes it possible to prevent a situation in which the thermal paper S enters the area between the guide portion 27*b* and the upper surface 27*f*. Further, when the upper surface 27*f* is constituted by a smooth surface, the behavior of the guide portion 27*b* is stable when the guide portion 27*b* is pressed by the movable blade 21 and moves along the upper surface 27*f*.

Further, in the configuration described above, the protruding portion 21*b* abuts the guide portion 27*b* in the process in which the movable blade 21 moves from the standby position UP to the cutting position CP. Therefore, the guide surface 27*h* is not in direct contact with the movable blade 21, and thus the effect of the guide surface 27*h* being less likely to be scratched can be expected.

1-3. Configuration of Printing Apparatus

As described above, the printing apparatus 100 transports the thermal paper S by the transport unit 70A and is printed by the printing unit 70 by the control of the control unit 300 in accordance with the print commands input from the host computer (not illustrated).

During the transport of the thermal paper S, the movable blade 21 is positioned in the standby position UP and is in a position apart from the transport path D. On the other hand, in the fixed blade 27, the guide portions 27*b* protrude to the transport path D. Thus, as described above, the thermal paper S is transported while in contact with the guide surfaces 27*h* of the guide portions 27*b*.

The printing apparatus 100 pauses the transport of the thermal paper S at the timing when the cutting position of the thermal paper S is between the movable blade 21 and the fixed blade 27 of the cutter apparatus 20. Here, the cutter apparatus 20 is operated to cut the thermal paper S.

In the cutter apparatus 20, the movable blade 21 moves from the standby position UP to the cutting position CP and, by this movement of the movable blade 21, the protruding portions 21*b* of holder 21*a* come into contact with the guide portions 27*b*. When the protruding portions 21*b* moves further, the guide portions 27*b* move along the upper surfaces 27*f* and the V-shaped cutting edge 21*v* and the cutting edge 27*g* come into contact.

Because the fixed blade 27 has a curvature, the cutting edge 21*c* and the cutting edge 21*d* of the movable blade 21 initially come into contact with both end portions of the cutting edge 27*g* in the width direction at a single point. Furthermore, the movable blade 21 moves in accordance with the curvature of the fixed blade 27, and the cutting edge 21*c* and the cutting edge 21*d* cut the thermal paper S while in contact with the cutting edge 21*g* at a single point. The point of contact between the cutting edge 21*c*, the cutting edge 21*d*, and the cutting edge 21*g* corresponds to a medium contact point.

As the movable blade 21 moves rearward, the point of contact between the cutting edge 21*c*, the cutting edge 21*d*, and the cutting edge 27*g* moves toward the center portion of the fixed blade 27 in the width direction. In this manner, in the process of cutting the thermal paper S, a state in which the movable blade 21 and the fixed blade 27 come into contact at a point is maintained, and thus cutting defects can be prevented and the cutter apparatus 20 with high cutting performance is realized.

Here, the upper surface 27*f* of the fixed blade 27 in contact with the movable blade 21 is pressed downward by the movable blade 21. As illustrated in FIG. 2, both ends of the fixed blade 27 in the width direction are engaged with the cover frame 12, and thus are supported by the cover frame 12 so as not to move in the up-down direction.

Further, a rigidity of the fixed blade 27 in the thickness direction is configured to be less than a rigidity of the movable blade 21 in the thickness direction. As a result, as the movable blade 21 moves rearward, the fixed blade 27 deforms under the pressing force of the movable blade 21, and the curvature of the fixed blade 27 is reduced, as illustrated in FIG. 5. That is, when the movable blade 21 moves to the cutting position CP and intersects with the fixed blade 27, the fixed blade 27 flexes, and thus the curvature of the fixed blade 27 changes following the movable blade 21.

The guide portions 27*b* are each biased to the fixed blade 27 by the arm 27*c*. As a result, the guide portions 27*b* are each displaced following the change in the curvature of the fixed blade 27, and move while in contact with the upper surface 27*f*.

This configuration makes it less likely for a gap to occur between the guide portion 27*b* and the fixed blade 27, and thus the thermal paper S pressed toward the fixed blade 27 by the movable blade 21 is less likely to be sandwiched between the fixed blade 27 and the guide portion 27*b*.

After cutting the thermal paper S, the printing apparatus 100 moves the movable blade 21 to the standby position UP, and subsequently transports the thermal paper S toward the paper discharge port 30. This allows the thermal paper S after printing to be removed.

A top margin M is formed on the thermal paper S printed by the printing apparatus 100, on an upper portion of a range in which text and images are printed, that is, downstream in the transport direction F. The top margin M is a section positioned between the printing unit 70 and the paper discharge port 30 when the printing unit 70 prints on the thermal paper S. The printing apparatus 100, to reduce the size of the top margin M, can backfeed the thermal paper S after receiving a print command from the host computer and before printing is started.

The printing apparatus 100 performs the operation of transporting the thermal paper S in a direction reverse to the transport direction F by the transport unit 70A before printing is started by the printing unit 70. This operation is referred to as a backfeed. During the backfeed, the presence or absence of the thermal paper S on which printing was performed and discharged to the paper discharge port 30 is not confirmed. As a result, the cut Sd of the thermal paper S may re-enter an interior of the printing apparatus 100 from the paper discharge port 30. When the amount of transport of the backfeed is large, the cut Sd is transported to the printing unit 70 side of the cutter apparatus 20. That is, the cut Sd may pass between the movable blade 21 and the fixed blade 27. The thermal paper S drawn from the roll paper R is curled when the thermal paper S becomes discontinuous at the cut Sd, and thus may become rounded, resulting in the possibility of getting caught when coming into contact with a member of the printing apparatus 100 during transport.

The printing apparatus 100 prevents the thermal paper S from getting caught during the backfeed by the guide portions 27*b*. During the backfeed, the guide portions 27*b* protrude to the transport path D further than the cutting edge 27*g*, and thus the thermal paper S is backfed while guided by the guide portions 27*b*. As a result, there is no risk of the thermal paper S getting caught in the fixed blade 27 at the cut Sd.

Further, the movable blade 21 is in the standby position UP and outside the transport path D during the backfeed, and thus there is no risk that the thermal paper S will get caught in the movable blade 21.

In this way, the cutter apparatus 20, by being provided with the curvature of the fixed blade 27, is configured to have high cutting performance, and the guide portions 27*b* protrude to the transport path D when the thermal paper S is transported, making it possible to prevent the thermal paper S from getting caught in the fixed blade 27. As a result, it is possible to backfeed the thermal paper S after printing to reduce the size of the top margin M.

As described above, the cutter apparatus 20 according to the exemplary embodiment to which the present disclosure is applied includes the fixed blade 27 and the movable blade 21 disposed facing the fixed blade 27, and is configured to cut the thermal paper S, which is a medium transported between the fixed blade 27 and the movable blade 21. The movable blade 21 is driven to reciprocate between the standby position UP away from the thermal paper S and the cutting position CP where the movable blade 21 intermeshes with the fixed blade 27. The cutter apparatus 20 includes the guide portion 27*b*. The guide portion 27*b* protrudes further toward the movable blade 21 than toward the cutting edge 21*c* and the cutting edge 21*d* of the fixed blade 27 when the movable blade 21 is in the standby position UP, and is pressed against the movable blade 21 and moves in a state of contact with the fixed blade 27 when the movable blade 21 is in the cutting position CP. The cutter apparatus 20 includes the arm 27*c* that biases the guide portion 27*b* toward the fixed blade 27.

According to the cutter apparatus 20 to which the present disclosure is applied, the cutting edge 21*c* of the fixed blade 27 and the guide portion 27*b* protruding further toward the movable blade 21 than toward the cutting edge 21*d* can prevent the thermal paper S transported between the movable blade 21 and the fixed blade 27 from getting caught. As a result, a paper jam caused by the thermal paper S getting caught can be prevented even when the thermal paper S after printing is backfed, for example. The guide portion 27*b* is biased toward the fixed blade 27 by the arm 27*c*, and thus a gap is less likely to occur between the guide portion 27*b* and the fixed blade 27. As a result, there is no risk of the thermal paper S entering between the guide portion 27*b* and the fixed blade 27. Furthermore, even in a configuration in which the fixed blade 27 is imparted with a curvature in order to enhance the cutting performance of the cutter apparatus 20, a configuration in which the guide portion 27*b* moves without producing a gap between the guide portion 27*b* and the fixed blade 27 can be realized.

In the cutter apparatus 20, as illustrated in FIG. 5, the fixed blade 27 is provided with a curvature convex in a direction indicated by the reference sign Z, which is the thickness direction. When the movable blade 21 moves to the cutting position CP and intersects with the fixed blade 27, the fixed blade 27 flexes. This causes the curvature of the fixed blade 27 to change following the movable blade 21.

With provision of the curvature to the fixed blade 27, the cutting edge 21*c* and the cutting edge 21*d* linear in shape each come into contact with the cutting edge 27*g* of the fixed blade 27 at a single point, and thus a configuration of the cutter apparatus 20 having a high cutting performance is high and favorable sharpness can be achieved. Further, even when the curvature of the fixed blade 27 deforms during the process of cutting the thermal paper S, the contact between the guide portion 27*b* and the fixed blade 27 is maintained, and thus the thermal paper S does not readily get caught in the fixed blade 27.

In the cutter apparatus 20, the movable blade 21 is provided with the V-shaped cutting edge 21*v* that protrudes in two directions toward the fixed blade 27, by the cutting edge 21*c* and the cutting edge 21*d*. The cutter apparatus 20 includes the pair of guide portions 27*b*, 27*b* corresponding to the cutting edge 21*c* and the cutting edge 21*d* of the movable blade 21. Each of the guide portions 27*b* moves in response to movement of the V-shaped cutting edge 21*v* of the movable blade 21.

As a result, the thermal paper S pressed toward the fixed blade 27 by the V-shaped cutting edge 21*v* does not enter between the guide portion 27*b* and the fixed blade 27 in the process of cutting the thermal paper S. Accordingly, the guide portion 27*b* is provided to ensure that the operation of cutting the thermal paper S is not hindered, thereby making it possible to prevent the thermal paper S from getting caught.

In the cutter apparatus 20, the arm 27*c* is a leaf spring.

The arms 27*c* is constituted by a leaf spring, making it possible to bias the guide portion 27*b* to the fixed blade 27 in an easy configuration. Further, the guide portion 27*b* can be biased by a mechanism having high durability.

In the cutter apparatus 20, the movable blade 21 is disposed in the main body frame 60, which is a first structure. The fixed blade 27 is disposed in the cover frame 12, which is a second structure, separate from the main body frame 60, and the cover frame 12 can change in posture relative to the main body frame 60. As a result, when the thermal paper S is disposed between the movable blade 21 and the fixed blade 27, the cover frame 12 is rotated relative to the main body frame 60, making it possible to easily arrange the thermal paper S.

In the cutter apparatus 20, in the process of the movable blade 21 moving from the standby position UP to the cutting position CP, the protruding portion 21*b*, which is the section other than the V-shaped cutting edge 21*v*, comes into contact with the guide portion 27*b*, thereby moving the guide portion 27*b*.

The protruding portion 21*b* and the guide portion 27*b* abut, and thus the guide portion 27*b* and the V-shaped cutting edge 21*v* do not come into contact with each other, and the guide portion 27*b* is less likely to be damaged. As a result, a durability of the guide portion 27*b* can be improved.

Further, the printing apparatus 100 according to the exemplary embodiment to which the present disclosure is applied includes the transport unit 70A configured to transport the thermal paper S, the printing unit 70 configured to print on the thermal paper S transported by the transport unit 70A, and the cutter apparatus 20 disposed downstream of the printing unit 70 in the transport direction F of the thermal paper S and configured to cut the thermal paper S.

According to the cutter apparatus 20 to which the present disclosure is applied, in the cutting apparatus 20, the cutting edge 21*c* of the fixed blade 27 and the guide portion 27*b* protruding further toward the movable blade 21 than toward the cutting edge 21*d* can prevent the thermal paper S transported between the movable blade 21 and the fixed blade 27 from getting caught. As a result, a paper jam caused by the thermal paper S getting caught can be prevented even when the thermal paper S after printing is backfed, for example. The guide portion 27*b* is biased toward the fixed blade 27 by the arm 27*c*, and thus a gap is less likely to occur between the guide portion 27*b* and the fixed blade 27. As a result, there is no risk of the thermal paper S entering between the guide portion 27*b* and the fixed blade 27. Furthermore, even in a configuration in which the fixed blade 27 is imparted with a curvature in order to enhance the cutting performance of the cutter apparatus 20, a configuration in which the guide portion 27*b* moves without producing a gap between the guide portion 27*b* and the fixed blade 27 can be realized. Further, the top margin M that occurs in the thermal paper S after printing can be reduced in size by backfeeding the thermal paper S and, when the thermal paper S is backfed, the thermal paper S can be prevented from getting caught in the cutter apparatus 20.

2. Second Exemplary Embodiment

2-1. Configuration of Cutter Apparatus

Next, a cutter apparatus 120 of a second exemplary embodiment will be described. Note that descriptions that are duplications of those of the cutter apparatus 20 of the first exemplary embodiment are omitted.

The cutter apparatus 120 is installed in the printing apparatus 100 in place of the cutter apparatus 20 described in the first exemplary embodiment. In contrast to the cutter apparatus 20 having a configuration in which the movable blade 21 moves in parallel toward the fixed blade 27 to cut the thermal paper S, the cutter apparatus 120 is a so-called scissors-type apparatus in which a movable blade 121 described later is rotated toward a fixed blade 127 to cut the thermal paper S. Note that, similar to the first exemplary embodiment, the movable blade and the fixed blade may be referred to as a first blade and a second blade.

The movable blade 121 is reciprocally movable between a predetermined standby position where the thermal paper S can be transported through the cutter apparatus 120 and a cutting position where the thermal paper S is cut between the movable blade 121 and the fixed blade 127. In the description of the second exemplary embodiment and in FIG. 7 to FIG. 8, the standby position and the cutting position of the movable blade 121 are denoted by reference signs A and B, respectively. Further, in FIG. 7 and FIG. 8, a width direction of the printing apparatus 100 and the cutter apparatus 120 is denoted by the reference sign X, and a rearward direction is denoted by the reference sign Y.

Figure 7:
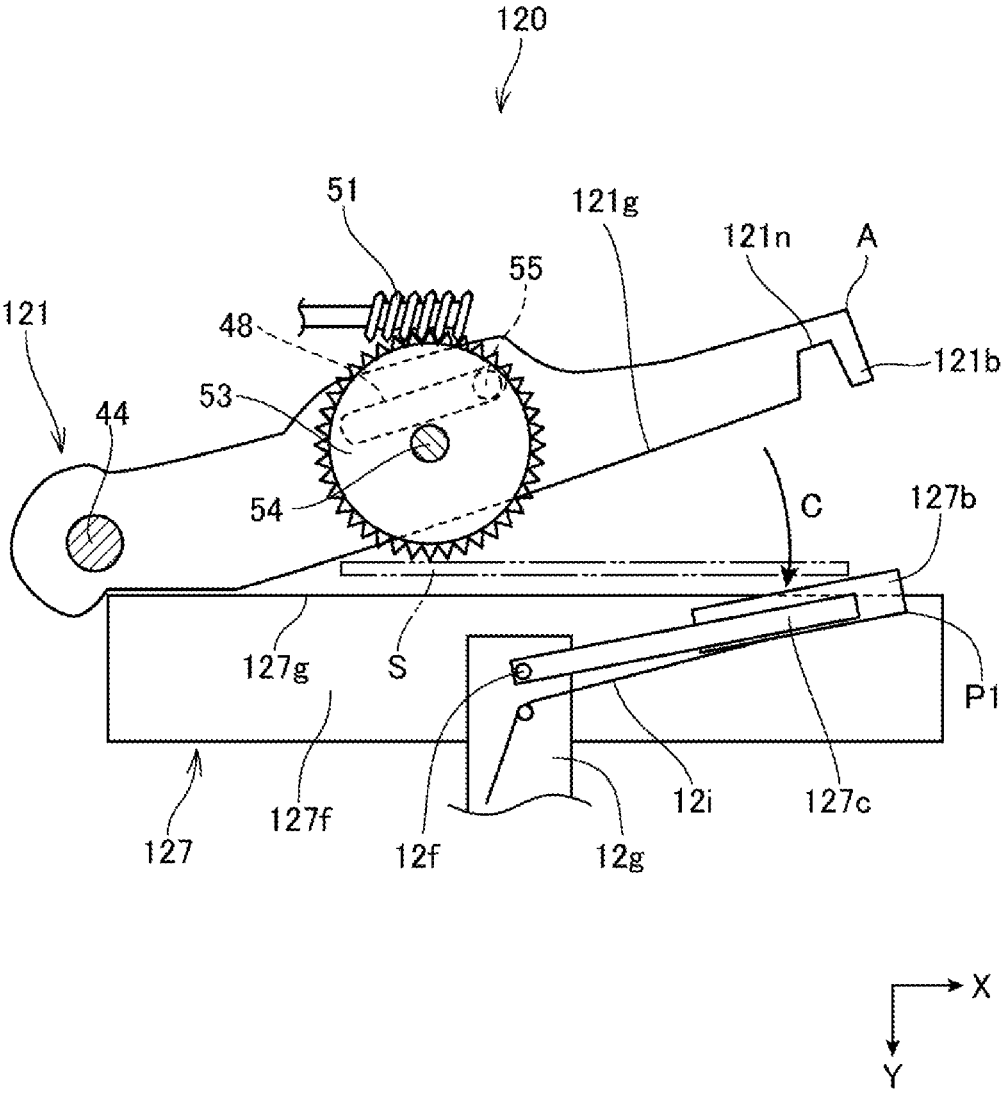
FIG. 7 is a plan view of main parts of a cutter apparatus according to a second exemplary embodiment.
Figure 8:
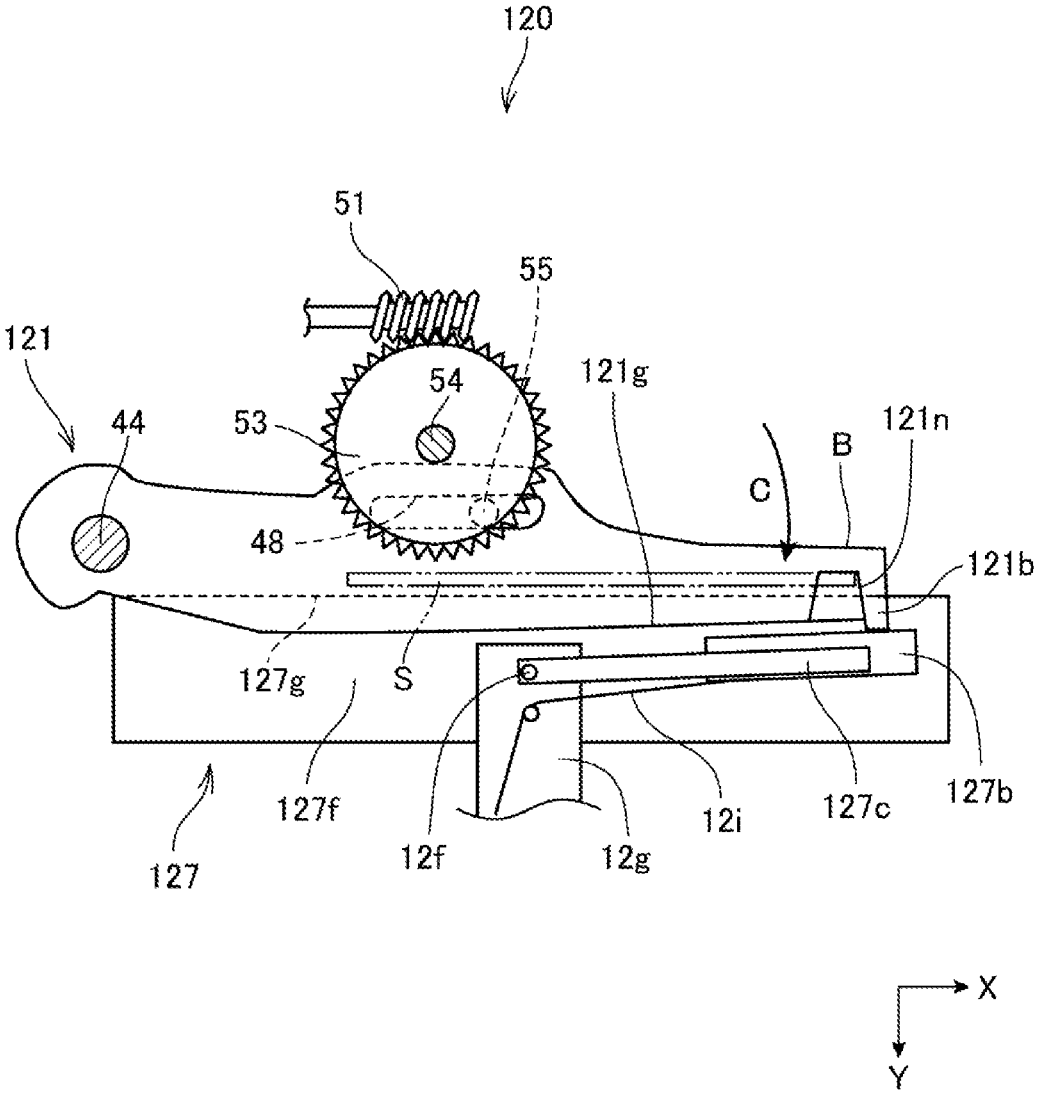
FIG. 8 is a plan view of the main parts of the cutter apparatus according to the second exemplary embodiment.

FIG. 7 is a plan view of the main parts of the cutter apparatus 120 of the second exemplary embodiment, and illustrates each part including the movable blade 121 and the fixed blade 127 positioned in a standby position A. FIG. 8 is a plan view of the main parts of the cutter apparatus 120 of the second exemplary embodiment, and illustrates each part including the movable blade 121 and the fixed blade 127 positioned in a cutting position B.

In a configuration in which the cutter apparatus 120 is provided to the printing apparatus 100, the movable blade 121 is attached to the main body frame 60 illustrated in FIG. 1 and the fixed blade 27 is attached to the cover frame 12.

The movable blade 121 is a plate member made of a metal and is rotatably supported on the main body frame 60 by a support shaft 44. A coil spring (not illustrated) is attached to the support shaft 44 by a push nut, and the biasing force of the coil spring maintains a pressure contact force between a cutting edge 121*g* of the movable blade 121 and a cutting edge 127*g* of the fixed blade 127 at a pressure contact force greater than or equal to that required to cut the thermal paper S. Note that the cutting edge 121*g* corresponds to an example of the first cutting edge and the cutting edge 127*g* corresponds to an example of the second cutting edge.

The movable blade 121 is driven by a drive motor (not illustrated) via a worm wheel 53 and a worm gear 51.

The worm gear 51 is coupled to the drive motor described above and the driving force of the drive motor causes the worm gear 51 to rotate. The worm gear 51 intermeshes with the worm wheel 53 and transmits a driving force to the worm wheel 53. The worm wheel 53 is rotatably attached to the main body frame 60 by a support shaft 54 and rotates in conjunction with the worm gear 51.

The worm wheel 53 is provided with a crank pin 55 vertically provided in an extending direction of the support shaft 54. The crank pin 55 is fitted into a slide groove 48 provided in the movable blade 121, and constitutes a crank mechanism with the slide groove 48. The crank pin 55 moves in the slide groove 48 as the worm wheel 53 rotates, and thus the movable blade 121 moves in a direction indicated by arrow C in FIG. 7.

In the standby position A, a predetermined gap is formed between the cutting edge 121*g* of the movable blade 121 and the cutting edge 127*g* of the fixed blade 127. This gap serves as the transport path D in which the thermal paper S is transported. In the cutting position B, the cutting edge 121*g* and the cutting edge 127*g* overlap and cut the thermal paper S.

The movable blade 121 is provided with a protruding portion 121*b* at a second end opposite to a first end connected with the support shaft 44. The protruding portion 121*b* protrudes further to the fixed blade 127 than to the cutting edge 121*g*.

The fixed blade 127 is fixed to the cover frame 12 by a stay 12*g*. The fixed blade 127 is, for example, a plate member made of a metal, and the cutting edge 127*g* is formed on an end portion facing the movable blade 121. The fixed blade 127 is provided with a curvature downwardly convex in a plate thickness direction. Thus, an upper surface 127*f* of the fixed blade 127 is a concave surface.

Further, a support shaft 12*h* is vertically provided on the stay 12*g*, and an arm 127*c* is rotatably attached to the support shaft 12*h*. The arm 127*c* is a rod-shaped leaf spring. A guide portion 127*b* is attached to a tip end of the arm 127*c*, and an elastic force of the arm 127*c* presses the guide portion 127*b* against the upper surface 127*f*. The arm 127*c* corresponds to an example of the first biasing member. Note that the arm 127*c* is not limited to a leaf spring as long as the arm 127*c* has an elastic force that biases the guide portion 127*b* toward the fixed blade 127. For example, a plurality of members including a compression coil spring and an elastic member such as rubber may be disposed in place of the arm 127*c*.

The guide portion 127*b* rotates with the arm 127*c* and slides over the upper surface 127*f*.

Further, a first end of a spring 12*i* is fixed to the stay 12*g*. The spring 12*i* is constituted by a torsion coil spring and a second end of the spring 12*i* abuts the guide portion 127*b* to bias the guide 127*b* toward the movable blade 121. The spring 12*i* corresponds to an example of the second biasing member.

The guide portion 127*b* is positioned in a position P1 in FIG. 7 with the movable blade 121 in the standby position A. The guide portion 127*b* protrudes further to the movable blade 121 than to the cutting edge 127*g* of the fixed blade 127 at the position P1. The guide portion 127*b* is regulated by an abutting member (not illustrated) so as not to move from the position P1 toward the movable blade 21.

2-2. Operation of Cutter Apparatus

When the worm gear 51 is driven by a drive motor (not illustrated), causing the worm wheel 53 to rotate once, the movable blade 121 rotates from the standby position A toward the cutting position B.

When the movable blade 121 rotates, the protruding portion 121*b* abuts the guide portion 127*b*. When the movable blade 121 rotates further, the protruding portion 121*b* presses the guide portion 127*b* against the biasing force of the spring 12*i*. As a result, the guide portion 127*b* moves to a position where the cutting of the thermal paper S is not hindered.

The rotation of the movable blade 121 brings the cutting edge 121*g* into contact with the cutting edge 127*g* of the fixed blade 127. Because the fixed blade 127 is provided with a curvature, the cutting edge 121*g* and the cutting edge 127*g*, linear in shape, form a single medium cutting point. Further, as the movable blade 121 rotates, the movable blade 121 rides on the upper surface 127*f* of the fixed blade 127, and the fixed blade 127 comes into contact with the movable blade 121 while reducing the curvature. That is, when the movable blade 121 moves to the cutting position B and intersects with the fixed blade 127, the fixed blade 127 flexes, and thus the curvature of the fixed blade 127 changes following the movable blade 121. In this process, the medium cutting point between the cutting edge 121*g* and the cutting edge 127*g* moves along the cutting edge 127*g*, and thus the thermal paper S is cut.

Further, a notch portion 121*n* is provided in the movable blade 121. At the notch portion 121*n*, a blade configured to cut the thermal paper S is not formed, and thus intermeshing with the fixed blade 127 does not occur even at the cutting position B. As a result, the thermal paper S remains uncut at the position of the notch 121*n*, and a partial cut is performed.

Next, when the movable blade 121 moves from the cutting position B to the standby position A, the guide portion 127*b* moves toward the movable blade 121 by the biasing force of the spring 12*i*. With the movable blade 121 in the standby position A, the guide portion 127*b* protrudes further to the movable blade 121 than to the cutting edge 127*g*. The thermal paper S is guided and transported by the guide portion 127*b*, and thus is less likely to come into contact with the cutting edge 127*g*, and is transported smoothly without getting caught in the cutting edge 127*g*.

As described above, the guide portion 127*b* is biased to the upper surface 127*f* by the arm 127*c*, and thus a state in which the guide portion 127*b* and the upper surface 127*f* come into contact with each other substantially without any gap is maintained. This makes it possible to prevent a situation in which the thermal paper S enters the area between the guide portion 127*b* and the upper surface 127*f*.

Further, because the guide portion 127*b* maintains a state in which the thermal paper S is less likely to come into contact with the cutting edge 127*g*, the thermal paper S does not readily come into contact with the cutting edge 127*g* even when the printing apparatus 100 backfeeds the thermal paper S as described in the first exemplary embodiment.

In this way, when the cutter apparatus 120 according to the second exemplary embodiment is applied to the printing apparatus 100, the same effects as those of the cutter apparatus 20 and the printing apparatus 100 described in the first exemplary embodiment are achieved.

That is, the cutter apparatus 120 is a scissors-type cutter in which the movable blade 121 and the fixed blade 127 form a single medium cutting point, and the medium cutting point moves in the process of the movable blade 121 moving from the standby position A to the cutting position B, cutting the thermal paper S. In this configuration as well, contact between the thermal paper S and the cutting edge 127*g* can be avoided by the guide portion 127*b*, making it possible to avoid a paper jam of the thermal paper S. Further, in order to ensure favorable sharpness of the cutter apparatus 120, the guide portion 127*b* is biased by the arm 127*c* even in a configuration in which the fixed blade 127 is provided with a curvature, and thus a gap is not likely to form between the guide portion 127*b* and the upper surface 127*f*. As a result, the cutter apparatus 120 that can prevent a paper jam of the thermal paper S by the guide portion 127*b* during backfeeding can be achieved.

3. Other Exemplary Embodiments

Note that the above-described exemplary embodiments merely illustrate one aspect of the present disclosure, and the specific aspects of the present disclosure and the scope of application of the present disclosure are not limited to the exemplary embodiments described above.

For example, the printing apparatus 100 illustrated in FIG. 1 has been described as a configuration in which the printing unit 70 also functions as a transport unit 70A for transporting the thermal paper S. However, the present disclosure is not limited to this configuration. For example, the transport unit 70A may have a configuration that includes a transport roller or the like configured to transport the thermal paper S.

Further, for example, the medium cut by the cutter apparatuses 20, 120 to which the present disclosure is applied is not limited to the thermal paper S having a roll shape, and may be a standard paper wound into a roll shape or other sheet. Furthermore, the cutter apparatuses 20, 120 to which the present disclosure is applied or the printing apparatus 100 including these may be configured to be incorporated into a device such as a multifunction machine or register.

What is claimed is:

1. A cutter apparatus for cutting a medium by a first blade and a second blade, the first blade moving between a standby position and a cutting position, the cutter apparatus comprising:

a guide portion configured to protrude further toward the first blade than a cutting edge of the second blade when the first blade is in the standby position, a first urging member configured to urge the guide portion toward the second blade, wherein, when the first blade moves from the standby position to the cutting position, the guide portion is pressed by the first blade to move in a state of contacting with the second blade, wherein the second blade includes a curvature in which both ends of the second blade are lower relative to a center portion of the second blade in a transport direction of the medium, and wherein when the first blade moves to the cutting position and intersects with the second blade, the second blade flexes, thereby causing the curvature of the second blade to change conforming to the first blade.

2. The cutter apparatus according to claim 1, wherein the first blade includes a cutting edge having a V-shape extending in two directions toward the second blade, a pair of the guide portions are provided to the cutting edge of the first blade, and the pair of the guide portions is configured to move in accordance with a movement of the first blade.

3. The cutter apparatus according to claim 1, wherein the cutter apparatus is of a scissors type having the first blade and the second blade that form a medium cutting point, and cuts the medium as the medium cutting point moves while the first blade is moving from the standby position to the cutting position.

4. The cutter apparatus according to claim 1, wherein the first urging member is a leaf spring.

5. The cutter apparatus according to claim 1, wherein the first blade is provided to a first structure, the second blade is provided to a second structure separate from the first structure, and the second structure is configured to change posture thereof relative to the first structure.

6. The cutter apparatus according to claim 1, wherein a portion other than a cutting edge of the first blade abuts against the guide portion while the first blade moves from the standby position to the cutting position.

7. A printing apparatus comprising:

a transport unit configured to transport a medium;

a printing unit configured to perform printing on the medium; and the cutter apparatus described in claim 1 provided downstream of the printing unit in a transport direction of the medium and configured to cut the medium.

* * * * *